US006685520B1

(12) United States Patent
Wiggins

(10) Patent No.: US 6,685,520 B1
(45) Date of Patent: Feb. 3, 2004

(54) SELF-RIGHTING INFLATABLE LIFE RAFT

(75) Inventor: Renard J. Wiggins, Los Angeles, CA (US)

(73) Assignee: Tritech Technology PTY LTD, Melbourne (AU)

( * ) Notice: Subject to any disclaimer, the term of this patent is extended or adjusted under 35 U.S.C. 154(b) by 0 days.

(21) Appl. No.: 09/959,969

(22) PCT Filed: May 15, 2000

(86) PCT No.: PCT/AU00/00461

§ 371 (c)(1),
(2), (4) Date: Jan. 31, 2002

(87) PCT Pub. No.: WO00/69718

PCT Pub. Date: Nov. 23, 2000

(30) Foreign Application Priority Data

May 14, 1999 (AU) ..... PQ0367
Sep. 3, 1999 (AU) ..... PQ2640

(51) Int. Cl.[7] ..... B63B 35/58
(52) U.S. Cl. ..... 441/40; 114/348
(58) Field of Search ..... 441/37–42, 129, 441/130; 114/345, 348, 349, 360; D12/316; D21/803

(56) References Cited

U.S. PATENT DOCUMENTS 4,180,882 A * 1/1980 Kawasaki ..... 440/38
4,573,933 A * 3/1986 Cameron ..... 441/40
4,998,900 A 3/1991 Wright
5,921,831 A 7/1999 Schulze
5,927,228 A 7/1999 Richard et al.
5,967,869 A 10/1999 Wiggins
6,077,138 A * 6/2000 Schulze ..... 441/40

FOREIGN PATENT DOCUMENTS

CA 527063 * 7/1956 ..... 441/40
FR 1127922 * 12/1956 ..... 441/40
JP 167291 * 10/1983 ..... 114/348
JP 9-20289 1/1997

* cited by examiner

*Primary Examiner*—S. Joseph Morano
*Assistant Examiner*—Andrew Wright
(74) *Attorney, Agent, or Firm*—Larson & Taylor PLCC

(57) ABSTRACT

A self-righting inflatable life raft (10) comprises a raft body (11) having inflatable side walls (21, 22) and a floor (15) located therebetween. At least two inflatable tube members form arches (51, 52) that extend from one side of the raft body to the other, each arch extends upwardly and outwardly from a perimeter of said raft body (11) at an angle from the perpendicular to said raft body. The life raft has a central axis of symmetry (61) and a center of gravity through which the weight of the life raft acts to rotate the raft on the surface of water from an unstable inverted position to a stable upright position. The tube members when inflated have a buoyancy sufficient to exert a turning moment on the life raft (10) causing the life raft to topple by gravity to an upright position. At least one inflatable interconnecting tube (70, 71, 72, 76, 77) is positioned between the arches (51, 52) and offset from the central axis (61) to increase the turning moment.

16 Claims, 6 Drawing Sheets

SELF-RIGHTING INFLATABLE LIFE RAFT

TECHNICAL FIELD

This invention relates to an inflatable life raft having inflatable tubes dimensioned and positioned to cause the life raft to turn upright in the water without assistance if the raft inflates in an inverted position or to return an inflated raft to an upright position if it is subsequently overturned.

BACKGROUND ART

In U.S. Pat. No. 4,998,900, there is described and illustrated a self-righting inflatable life raft having upwardly and outwardly extending inflatable tubes. These tubes are arranged to cause the life raft to be unstable if inverted. In particular, the centre of gravity of an inverted life raft will fall outside the supporting area, that is the top of the inflatable tubes, so that the life raft will topple under gravity back to an upright position.

If the inflatable tubes in these prior constructions do not inflate or, after inflation are subsequently collapsed or distorted, they may not adopt their desired positions extending upwardly and outwardly from the side of the walls of the main body, sufficient to make the life raft topple to the upright position.

In patent application PCT/AU96/00409 similar self-righting inflatable life rafts were disclosed incorporating ties in the form of flexible ropes, wires or inflatable tubes fixed between two spaced points on the life raft to limit separation of the two points to the length of the tie during and after inflation of the tube members. The two points were chosen to inhibit distortion or collapse of the tube members from their desired positions when inflated.

SUMMARY OF INVENTION

It is an object of the present invention to provide a life raft which can reliably return to an upright position if inverted.

According to the present invention there is provided a self-righting inflatable life raft comprising a raft body having inflatable side walls and a floor located therebetween; and at least two inflatable tube members forming arches that extend from one side of the raft body to the other, each arch extending upwardly and outwardly from a perimeter of said raft body at an angle from the perpendicular to said raft body; said life raft having a central axis and a centre of gravity through which the weight of the life raft acts to rotate the raft on the surface of water from an unstable inverted position to a stable upright position, wherein the tube members have a buoyancy sufficient to exert a turning moment on said life raft causing said life raft to topple by gravity to an upright position, characterised in that at least one inflatable interconnecting tube is positioned between the arches and offset from a central axis to increase the turning moment.

BRIEF DESCRIPTION OF THE DRAWINGS

Embodiments of the present invention will now be described by way of reference only with reference to the accompanying drawings in which.

DESCRIPTION OF THE PREFERRED EMBODIMENTS

Figure 12:
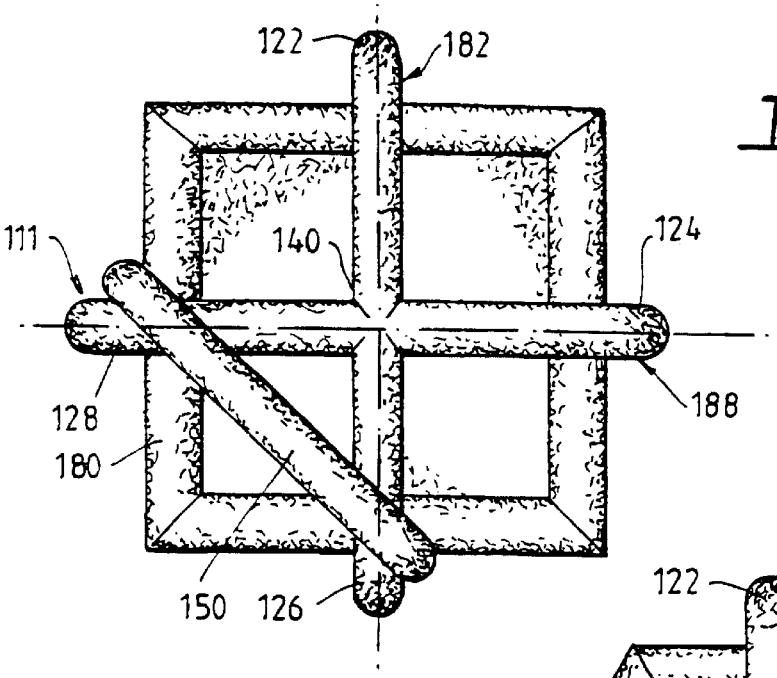
FIG. 12 is a plan view of a square life raft in accordance with the present invention.
Figure 13:
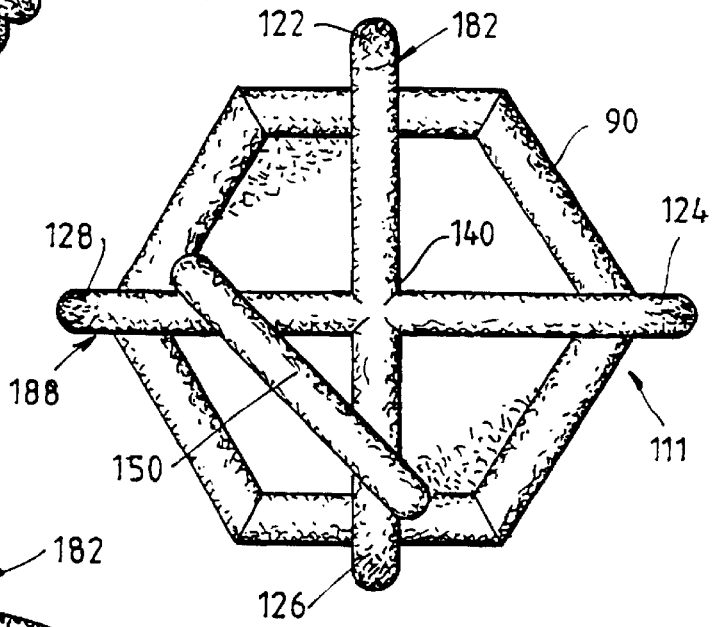
FIG. 13 is a plan view of a hexagonal life raft in accordance with the present invention.

FIGS. 1 to 6 are views of a first embodiment of a self-righting life raft that is designed to hold six people. FIGS. 7 to 10 illustrate a second embodiment of a life raft which is designed to hold twenty-five people. FIGS. 11 to 13 illustrate life rafts having base structures of different shapes. It is understood that the life raft may be scaled up or down in size to accommodate varying numbers of persons. For example, the size of the first embodiment can be altered to accommodate six, fifteen or twenty-five persons.

The life raft is constructed of inflatable tube sections and all Figures show various embodiments of life rafts in fully inflated operational configurations. It is however understood that the life raft is designed to be stored in a collapsed configuration where the tubes are deflated and the whole raft can be folded into a suitable container. To use the life raft, the life raft is dropped into the water and then on appropriate signal one or more gas cylinders that are housed within the life raft structure open to inflate the tube sections to cause the life raft to progressively assume an inflated configuration.

The self-righting life raft 10 illustrated in the accompanying drawings is constructed of inflatable tube sections that are coupled together to define a life raft comprising a base structure 11 and a superstructure 12 formed by an arrangement of arches. The geometry and arrangement of the inflatable tubes is such that the life raft always assumes an upright configuration with the superstructure 12 being above the water level.

The superstructure 12 supports a canopy 13 (shown in FIG. 1) that extends above the base structure 11 which has a floor 15. The floor has two central drainage holes 17 for draining water if the base structure fills with water. It is understood that the present embodiments of the self righting life raft contain standard features common to most life rafts including stabilising pockets which fill up with water to act as ballast, a drogue, lights, deflate screws, etc. Such standard features have been omitted from the drawings in the interest of clarity.

As shown in FIGS. 1 to 6, the base structure 11 and superstructure 12 of the first embodiment are constructed from linear cylindrical tube sections that are joined together in an angular array to define the structure as shown in the drawings. The base structure 11 comprises two superimposed arrays of tube sections defining a lower base panel 21 and an upper base panel 22 (see FIGS. 10 and 11 for views of upper and lower base panels of the second embodiment) and a further array of tube sections defining a sub-panel 25 located under lower panel 21. Each base panel 21 or 22 comprises twelve segments that include two side panels 23, two end panels 40 and interconnected panels 41 between the side and end panels so that the base is somewhat in the form of an oblong with longer sides and shorter ends. One shorter end supports an entry platform 30 comprising a tubular cross member 33 that is attached parallel to shorter side panel 40. The other end supports a rope ladder 26 which hangs on the outside of the base structure 11. The upper base panel 22 is substantially the same as the lower base panel 21 and is superimposed vertically with the floor 15 attached to the base of the lower panel. Sub-panel 25 is shown in greater detail in FIG. 6. Sub-panel 25 comprises a circular array of six inflatable tubes forming a hexagon with one pair of opposing tubes being aligned parallel with side panels 23 of base panel 21. Slightly recessed from the perimeter of base panel 21, sub-panel 25 extends across the width and length of the base structure and provides spacing between floor 15 and cold water beneath the life raft so as to insulate the floor from the cold water.

The superstructure 12 is illustrated in FIGS. 2 to 5 and comprises two transverse arches 51, 52 extending transversely across the life raft 10. Transverse arches 51, 52 comprise a pair of outwardly inclined outboard struts 60 joined to a pair of inwardly inclined intermediate struts 62 that are in turn joined to a pair of further inwardly inclined roof struts 63. Roof struts 63 meet at an apex 64 at the central longitudinal axis 61 (FIG. 3) of the life raft 10. Transverse arches 51, 52 are positioned in a parallel spaced apart manner extending across the side panels 23 of the base structure 11.

Transverse arches 51, 52 are interconnected by an upper interconnecting tube 76 and a lower interconnecting tube 77. Both interconnecting tubes 76, 77 are asymmetrically arranged of the arches to improve the self-righting characteristics of the raft. Both interconnecting tubes are also offset from the central axis 61. Upper interconnecting tube 76 interconnects the arches 51, 52 on one side of the central axis between corresponding roof struts 63. Upper tube 76 is positioned on roof struts 63 closer to the apex 64 of the arches than the joint 65 between roof strut 63 and intermediate strut 62. Lower interconnecting tube 77 is located between the arches on the other side of the central axis to upper interconnecting tube 76. Specifically, lower interconnecting tube 77 is located at the joint 74 of outboard strut 60 and intermediate strut 62. Lower interconnecting tube 77 also has rounded end portions 73 protruding from the other side of joint 74 to the main portion of lower tube 77. The lower interconnecting tube 71 is larger in diameter than upper interconnecting tube 76.

The combination of inflatable interconnecting tubes 76, 77 and the outward inclination of the arches provides the raft with a righting ability wherein stability and buoyancy in righting moments enable the life raft to self right if inflated inverted.

The base structure 11 is further provided with thwarts 75, that is, linear inflatable tubes provided transversely above the floor 15. Specifically, two thwarts are provided above floor 15 between side panels 23 and generally vertically aligned with transverse arches 51, 52. The thwarts provide structural rigidity to the life raft 10 and ensure the base structure 11 is flat when inflated such that, when inverted, the weight of the life raft, particularly the base structure, acts through the centre of gravity of the raft causing it to rotate into an upright position. Additionally, the thwarts ensure that the base structure does not fold under the weight of occupants when the raft is inflated. Thwarts 75 can double as seats for occupants.

When inverted the buoyant superstructure causes the line of force of the centre of gravity to fall outside the area supporting the raft thus causing the raft to become unstable and rotate into an upright position where the raft reaches a state of equilibrium.

Figure 1:
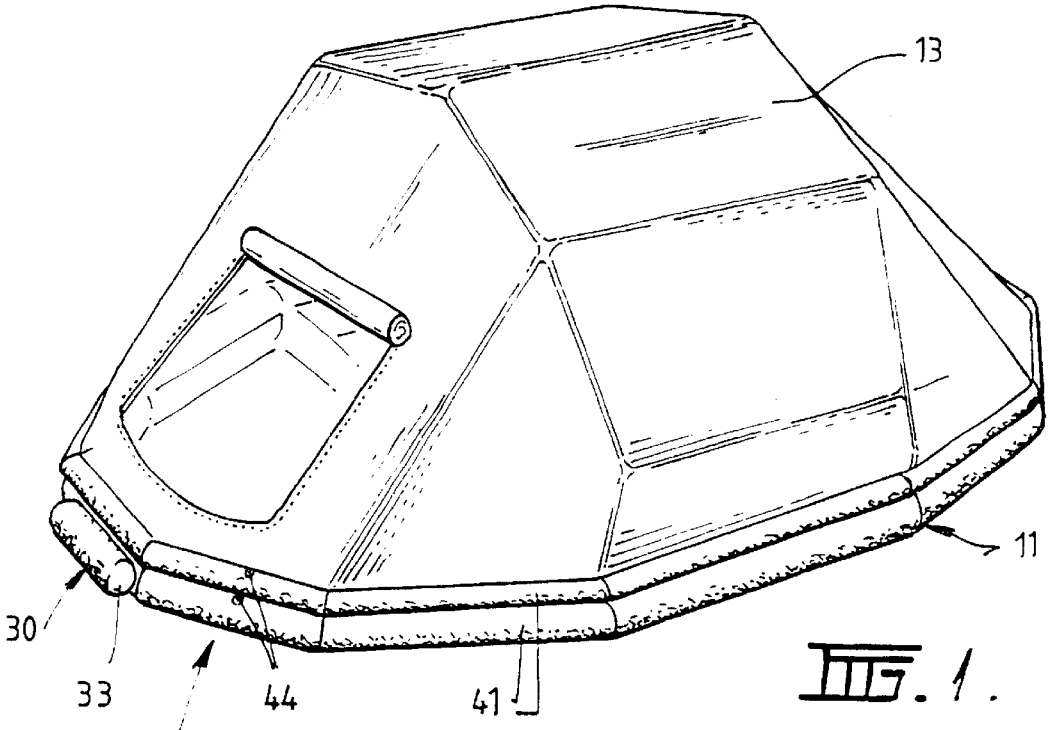
FIG. 1 is a perspective view of first embodiment of a self-righting life raft of the present invention.
Figure 2:
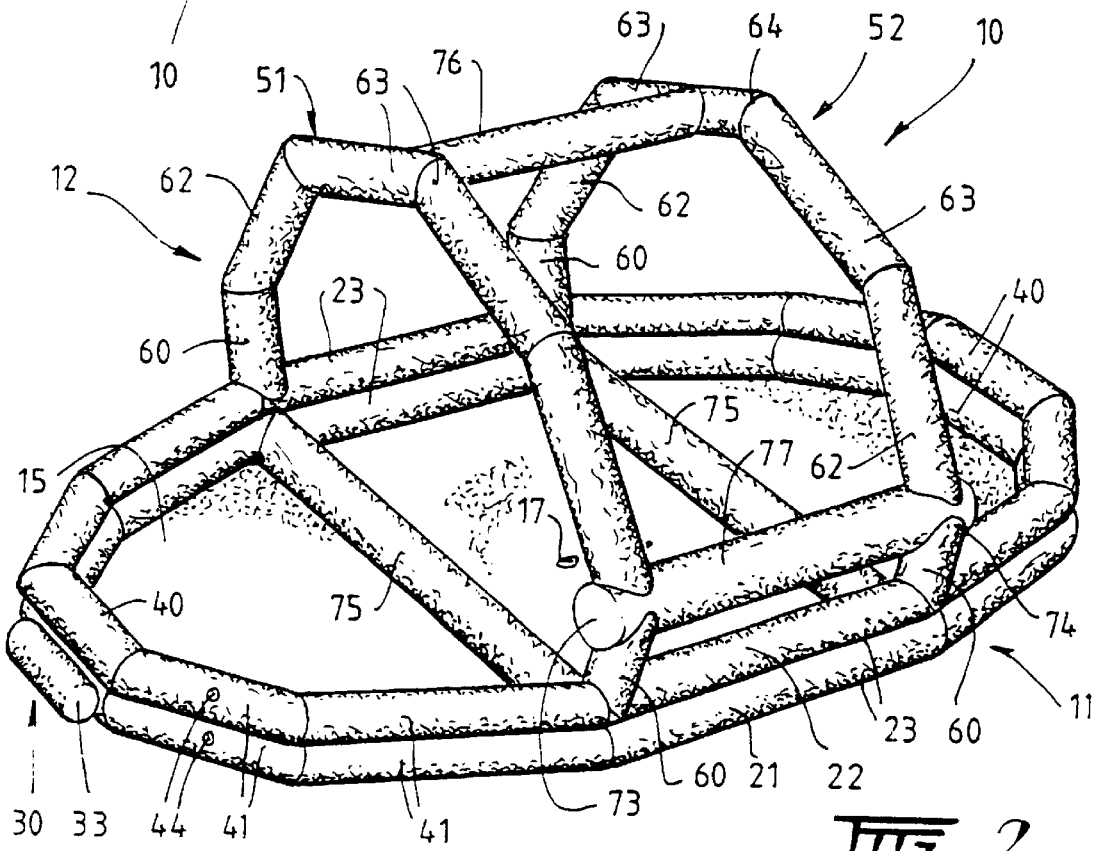
FIG. 2 is a similar view of the life raft in FIG. 1 but with the canopy removed.
Figure 3:
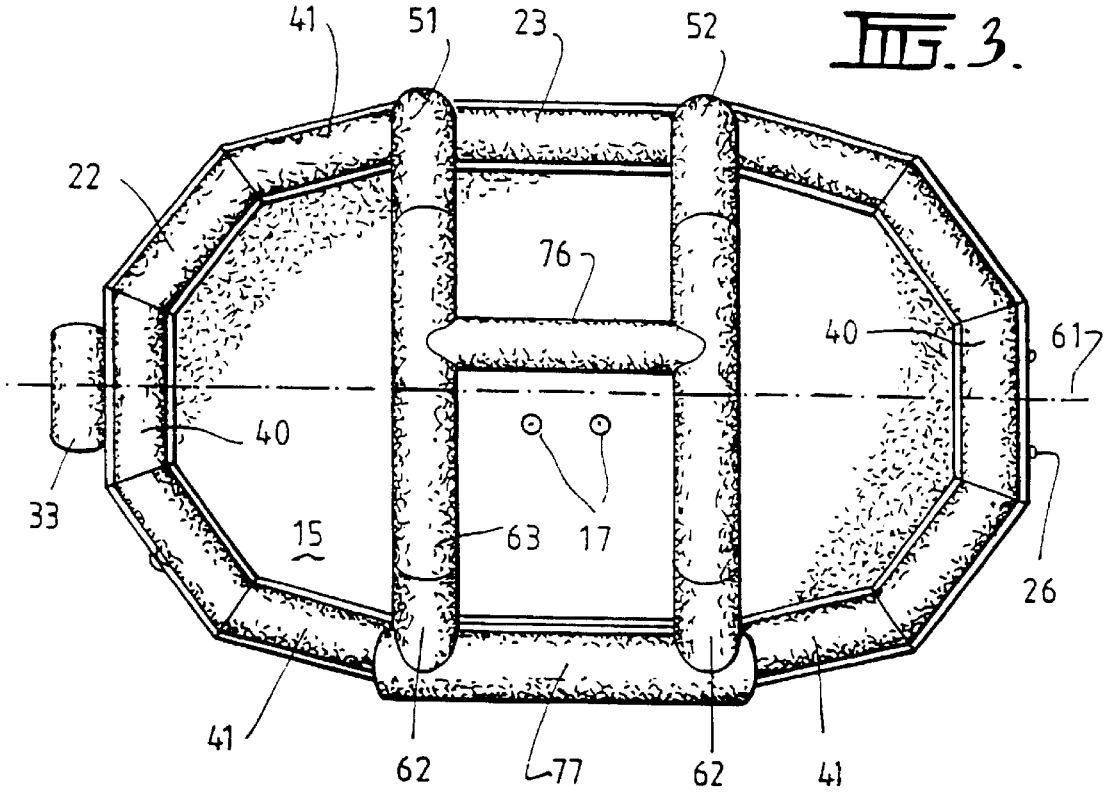
FIG. 3 is a plan view of the life raft in FIG. 2.
Figure 4:
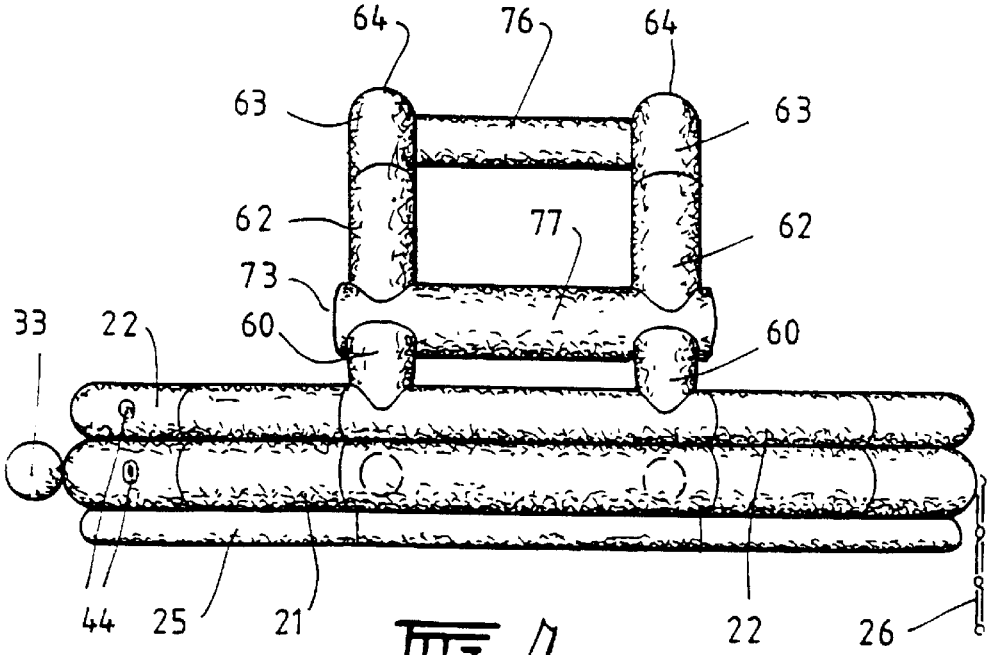
FIG. 4 is a side view of the life raft in FIG. 2.
Figure 5:
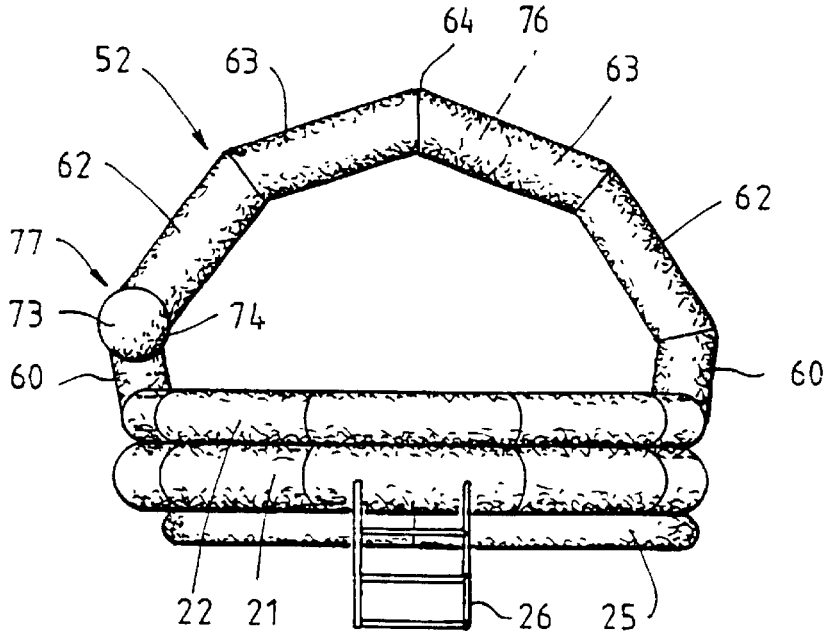
FIG. 5 is an end view of the life raft in FIG. 2.
Figure 6:
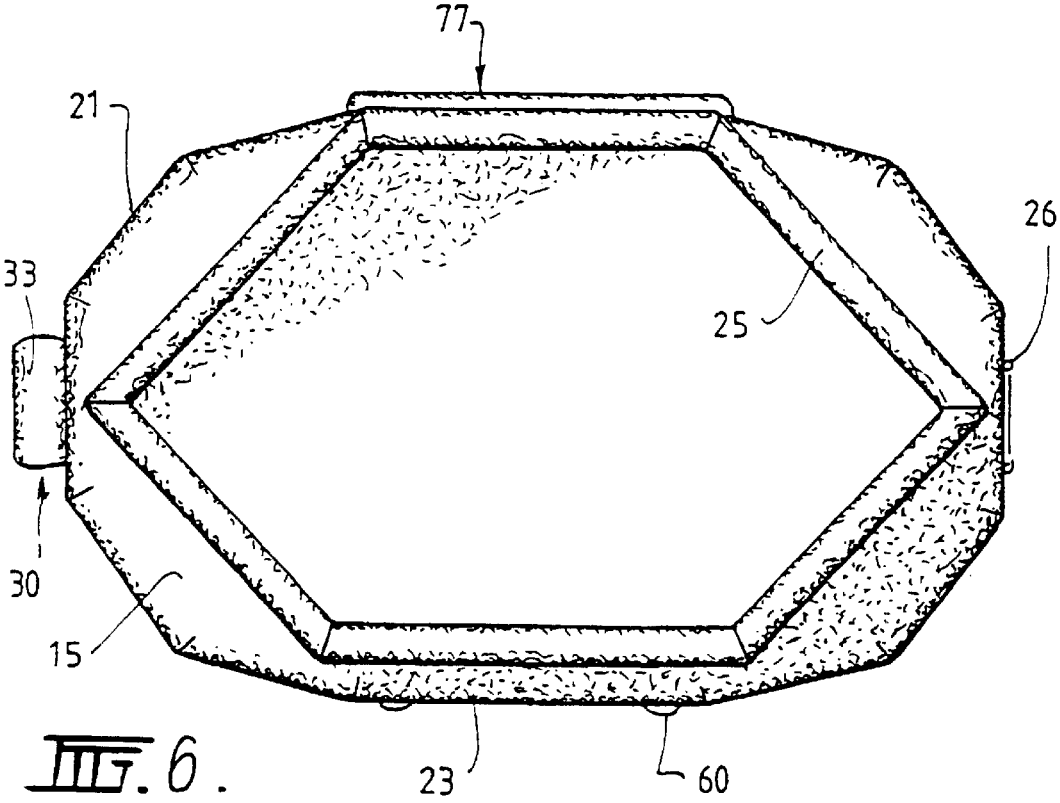
FIG. 6 is a view of the underside of the life raft in FIG. 2.

As shown in FIG. 1 the canopy-type cover 13 is suspended above the base structure 11 and over the superstructure to protect the occupants from wind, rain and sun exposure. Additionally, the canopy has the effect of limiting movement between the arches and base structure and between the arches themselves which encourages the superstructure to achieve the desired configuration upon inflation. Generally, the canopy 13 is attached at its perimeter to the sidewalls defined by the base structure 11 and suspended centrally from the transverse arches 51, 52. The canopy in the first embodiment has two entrance openings, one at each end and corresponding with platform 30 and ladder 26. The canopy is typically made from a lightweight fabric which repels rain and wind but allows breatheability of the enclosed area of the raft 10.

As mentioned above, the arches, the beams, the base structure and thwarts are formed by cylindrical tubes that are interconnected to define two closed pneumatic circuits that are inflated by means of two gas cylinders (not shown) that are supported beneath the base structure and open at a predetermined signal. The gas cylinders carry more than enough gas to inflate the life raft structure to the desired pressure. A first cylinder inflates the lower half of the base structure 11 including thwarts whilst the second cylinder inflates the top half of the base structure 11 and the superstructure 12. Each circuit is provided with pressure relief valves 44 that allow excess gas pressure to be released thereby ensuring that the circuits are inflated to the desired pressures. The length of the tube sections vary depending on where they are positioned in the structure and the diameters of tube sections vary between approximately 250 mm to 400 mm depending once again on their position. For example, lower base panel 21 in the first embodiment is 380 mm in diameter whereas upper base panel 22 has a diameter of 310 mm. Likewise, lower interconnecting tube 77 has a larger diameter at 400 mm compared with upper interconnecting tube 76 which has a diameter of 270 mm. Diameter dimensions of the inflatable tubes may not be readily discernible from the drawings.

The self-righting characteristics of the raft are defined by the buoyancy forces that are placed on the raft structure should it be inflated whilst inverted in the water. The design of the superstructure with the outwardly angled outboard struts and the asymmetric location of the interconnecting beams has the effect of imparting an upward buoyancy force that causes the structure to turn about an axis and rotate to a righting position. The diameters of the tubes and the inflation pressures have been carefully selected to ensure there is an adequate force to impart the desired rotation. It has been discovered that tubes inflated to 3.5 psi for the upper base panel 22 and superstructure 12 and 2.5 psi for the lower base panel 21 and thwarts 75 provides the adequate buoyancy force. The pressure relief valves ensure that the tube sections are inflated to the desired pressure and it is important to note that the life raft must operate satisfactory between extreme temperatures of −30° C. and +65° C.

A second embodiment of the life raft 10 is illustrated with particular reference to FIGS. 7 to 11 and comprises the two transverse arches 51, 52 described in the first embodiment with the addition of a longitudinal arch 50. The longitudinal arch 51 extends along the central longitudinal axis 61 of the life raft and comprises a pair of inclined uprights 53, 54 joined by a horizontally extending cross member 55. Each transverse arch 51 or 52 extends transversely across the life raft 10 as in the first embodiment but comprises a pair of outwardly inclined outboard struts 60 joined directly to a pair of inwardly inclined roof struts 63 that meet at the apex 64 along the central longitudinal axis 61 of the life raft 10. The roof struts 63 of the arches extend over the top of, and are secured to, the cross member 55 of the longitudinal arch 50. The transverse arches 51, 52 in this embodiment are interconnected by three interconnecting tube members 70, 71, 72.

Figure 10:
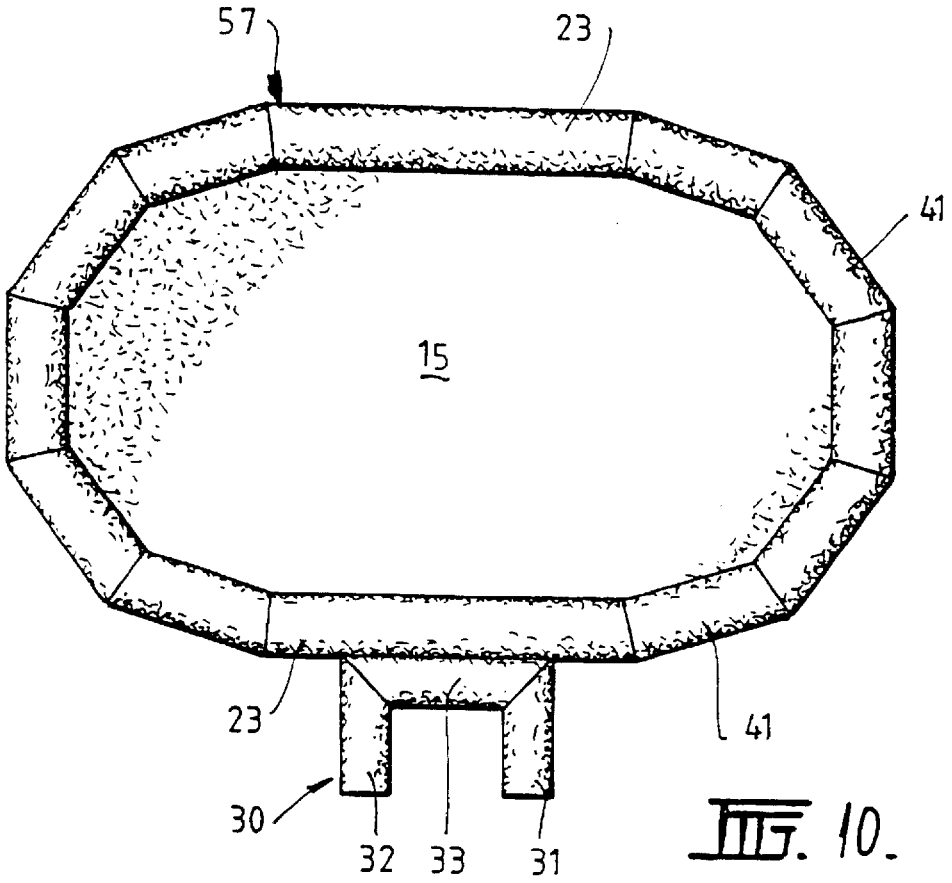
FIG. 10 is a plan view of a lower panel of the base structure of the second embodiment of the life raft.
Figure 11:
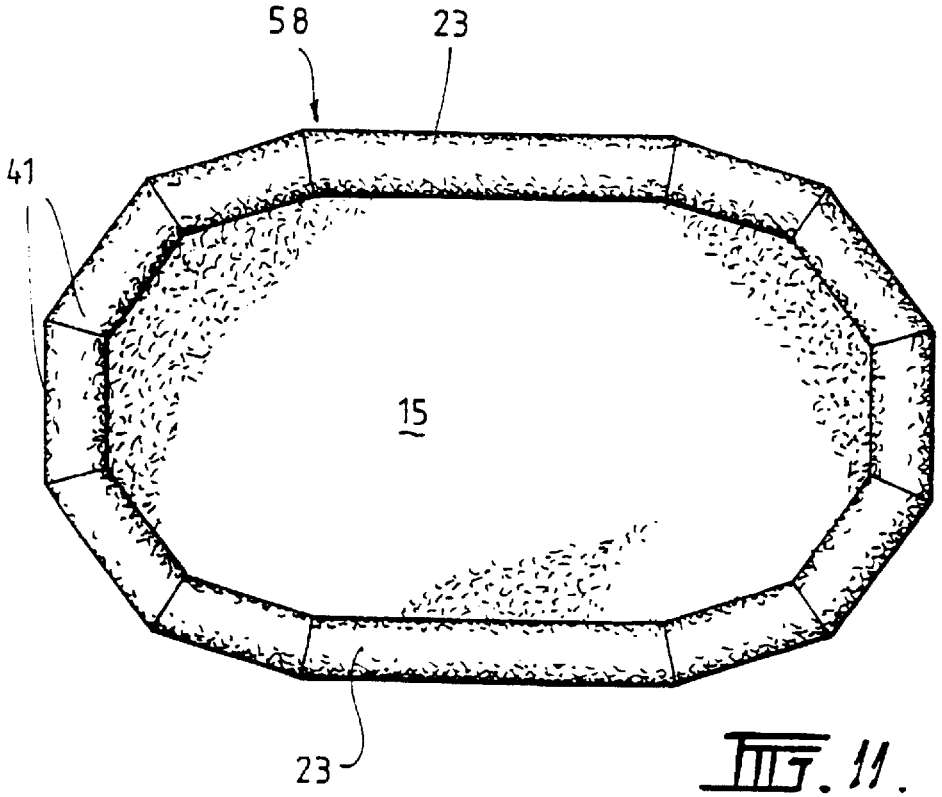
FIG. 11 is a plan view of an upper panel of the base structure of the second embodiment of the life raft.

FIGS. 10 and 11 show the lower base panel 57 and upper base panel 58 which superimpose to define the base structure. In this embodiment the base structure comprises twelve panel segments that include two longer side panels 23 and ten interconnected shorter panels 41. There is only one entry platform 30 situated at one of the longer side panel 23 and it comprises a tubular cross member 33 attached parallel to side panel 23 and a pair of parallel tubular arms 31, 32 extending from tubular cross member 33. Accordingly, the canopy in this embodiment (not shown) has only one entrance opening at side 23 of raft corresponding with entry platform 30.

Figure 7:
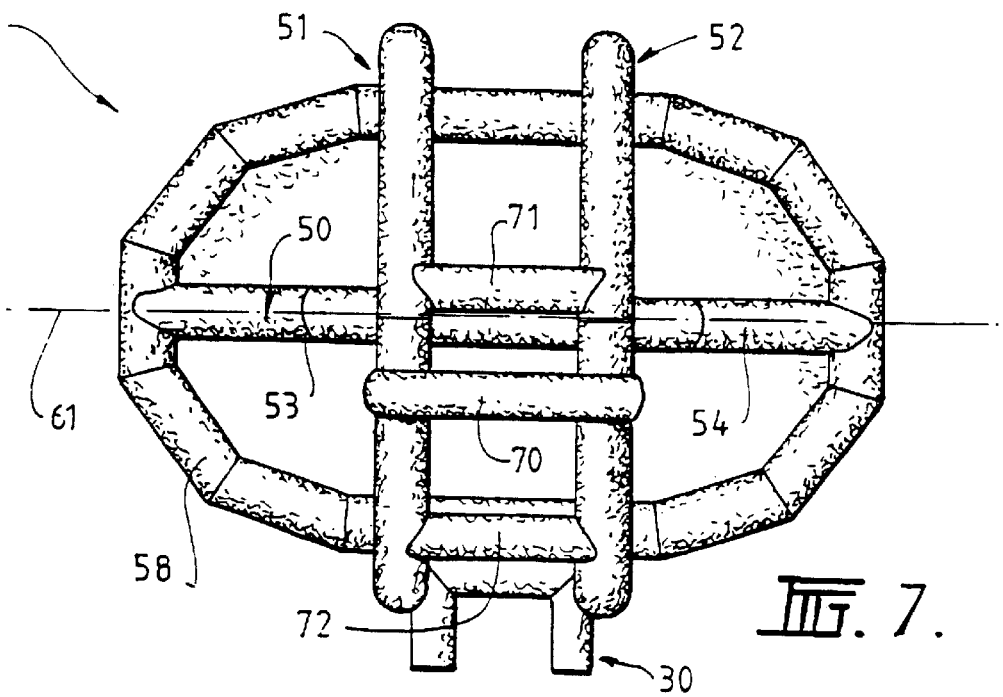
FIG. 7 is a plan view of a second embodiment of a self-righting life raft of the present invention.

The three interconnecting tubes 70, 71, 72 are specifically positioned asymmetrically of the raft 10 to improve the self-righting characteristics of the raft. The interconnecting tubes are designed to be of 300 mm cylindrical tube sections. The two tubes 71, 72 extend between the arches in the same plane as that part of the arches. The tube 72 is located just inside the join of the outboard strut 60 and roof strut 63 on one side of the raft. The tube 71 is positioned just to the other side of the central axis 61, or other side of the cross member 55, near the apex 64 of the transverse arches 51, 52. The third tube 70 is positioned to extend across the top of the transverse arches 51, 52 at a position near the apex of the tubes but below the central axis as shown in FIG. 7. Two (70, 71) of the three tubes 70, 71, 72 are positioned on one side of the raft 10 axis 61. This is also the side that facilitates passenger entry via the entry platform 30. The location of two 70, 72 of the tubes to the one side and the third tube 71 on the other side near the central axis prevents kinking of the arches on inflation and further enhances the upwardly rotational force that causes self-righting of the raft 10.

Figure 8:
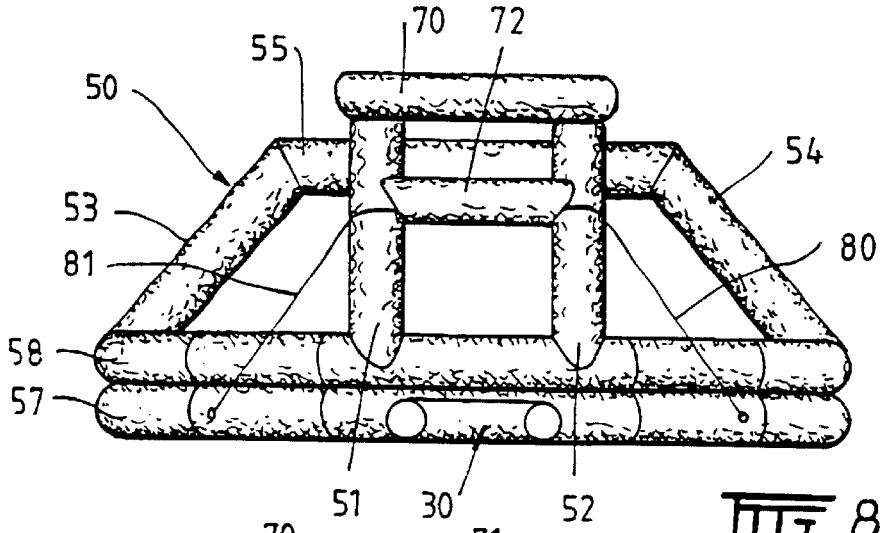
FIG. 8 is a side view of the life raft in FIG. 7.
Figure 9:
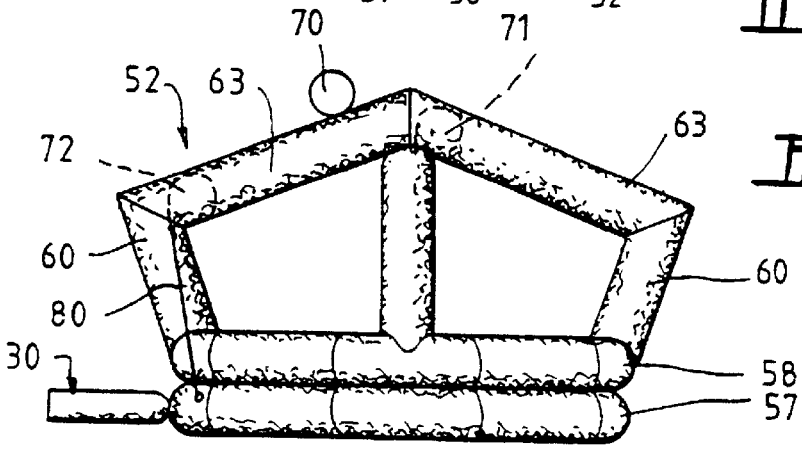
FIG. 9 is an end view of the life raft in FIG. 7.

It is important that the tubes and arches that make up the self righting superstructure assume the desired configuration on inflation. Thus, kinking or entanglement of the tubes and arches must be avoided and stability and buoyancy improved. The interconnecting tube members overcome the problem of kinking and entanglement. However as a further feature the second embodiment also includes ties 80, 81 positioned between the base structure and the arch tubes to limit the amount of movement that the arches can move away from the base structure. The position of the ties 80, 81 is shown in detail in FIGS. 8 and 9. Essentially the ties 80, 81 simply comprise a length of 8 to 10 mm rope that is attached at either end to include patches that are glued onto the structure of the life raft. As shown in FIGS. 8 and 9 two ties 80, 81 are positioned on the same side of the raft, that is the entry side. One tie 80 is coupled to the right hand transverse arch 52 of FIG. 8 on the center line of the roof strut 63 at a position inside but close to the join between the outboard strut 60 and roof strut 63. The other end of the tie 80 is attached to the edge of one shorter panel 41 of the lower base panel 57. The other tie 81 is attached to the left hand transverse arch 51 of FIG. 8 in a symmetrical manner as the tie 80.

Figure 14:
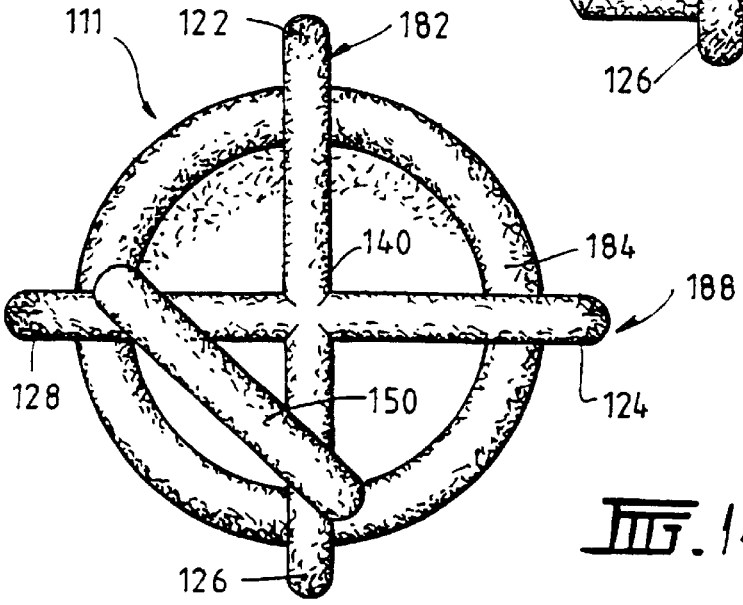
FIG. 14 is a plan view of a circular life raft in accordance with the present invention.

Life rafts of a third embodiment are illustrated in plan view in FIGS. 12 to 14. The rafts have base structures of different cross section so that FIG. 12 illustrates a square base 180, FIG. 13 a hexagonal base 90 and FIG. 14 a circular base 184. These life rafts are smaller than the life raft of the first and second embodiments. The life raft is constructed of the same type of cylindrical tube members as described with reference to the first and second embodiments. However, the superstructures 111 of these rafts are different from previous embodiments in that they comprise two inflatable arches 182, 188 positioned mutually perpendicular to each other rather than parallel. The crossing point of the arches forms the central apex 140 of the superstructure. The arches of the superstructure 111 are in the form of inflatable tube sections 122, 124, 126 and 128 that extend upwardly and outwardly of the base structure to converge towards the apex 140 of the structure. The arches as shown in FIGS. 12 to 14 each comprise outwardly inclined uprights and join with roof struts that meet at the central apex 140. In these life rafts, the central axis about which the raft undergoes a turning moment extends across the raft along either one of the two arches 182, 188.

In all the embodiments shown in FIGS. 12 to 14 a single bridging beam in the form of an inflatable tube 150 is positioned on top of the arches extending between two adjacent arch tube members in one corner of the raft as shown. The bridging tube 150 is positioned on top of the arch tube members and is a cylindrical tube that is longer than the space between the arch members so that the tube as shown in the drawings overlaps at its ends 151, 152. The tube 150 is specifically positioned near the corner of the raft that is adjacent the opening in the canopy. Tube 150 is positioned upward and outward of the arch members to increase the buoyancy effect that the tube has on the life raft should it be inflated in an inverted position. The fact that it is also offset from the central axis of the raft causes a turning moment which encourages the raft to self right.

In a fourth embodiment, the arches of the oblong-shaped raft in the first and second embodiments, are interconnected by one, two or three symmetrically positioned interconnecting tube members extending laterally on either side of the central axis between the arches in a spaced parallel configuration. In other words, one, two or three pairs of interconnecting tubes are arranged between the arches symmetrically of the central axis and the longitudinal arch (if one is provided). The interconnecting tubes are of the same diameter as the other arch tube members and are inflatable in the same manner. In a situation where a life raft has more than two arches it is understood that all the arches will be interconnected by the interconnecting tube members. Inextensible straps, ropes or ties between the arches further increases the self righting characteristics of the life raft by restricting the orientation of the tube members when deflated and ensuring that as the tube members inflate they assume the geometry that ensures that the raft rotates to the correct floating position.

It will be understood to persons skilled in the art of the invention that many modifications may be made without departing from the spirit and scope of the invention.

What is claimed is:

1. A self-righting inflatable life raft comprising:

a raft body having inflatable side walls and a floor located therebetween; and at least two inflatable tube members forming arches that extend from one side of the raft body to the other, each arch extending upwardly and outward from a perimeter of the raft body at an angle from the perpendicular to the raft body;

the life raft having a central axis of symmetry and a center of gravity through which the weight of the life raft acts to rotate the raft on the surface of water from an unstable inverted position to a stable upright position, wherein the tube members when inflated have a buoyancy sufficient to exert a turning moment on the life raft causing the life raft to topple by gravity to an upright position, and at least one inflatable interconnecting tube which is asymmetrically positioned between the arches relative to the central axis to introduce asymmetry to the self-righting raft thereby creating, when the life raft is in the inverted position and the tube is inflated, an upward force offset from the central axis which causes a turning moment to assist in rotating the life raft to the stable upright position.

2. The life raft claimed in claim 1 wherein the raft body is elongate with a longitudinal central axis and has two spaced apart parallel arches.

3. The life raft claimed in claim 2 wherein a plurality of inflatable interconnecting tubes are arranged spaced apart asymmetrically of the central axis between the arches.

4. The life raft claimed in claim 3 wherein two inflatable interconnecting tubes extend between the arches, a first tube being located near the top of the arches one side of the central axis, and a second tube being located on the other side of the axis and at the outermost point of the arch relative to the perimeter of the raft body.

5. The life raft claimed in claim 4 wherein the second interconnecting tube has a greater diameter than the first interconnecting tube.

6. The life raft claimed in claim 1 wherein a plurality of inflatable interconnecting tubes are arranged spaced apart symmetrically of the central axis between the arches.

7. The life raft claimed in claim 6 wherein the plurality of interconnecting tubes are one, two or three pairs of interconnecting tubes arranged symmetrically of the central axis.

8. The life raft claimed in claim 2 wherein the arches are joined to a longitudinal arch comprising inflated tube members positioned along the longitudinal central axis of the life raft.

9. The life raft claimed in claim 1, wherein ties extend between the arches and the side walls.

10. The life raft as claimed in claim 9 wherein each tie comprises a flexible substantially inextensible line.

11. The life raft as claimed in claim 9 wherein at least two ties are symmetrically arranged relative to the arches so that one at the two ties inhibits distortion or collapse of the arches in one direction and the other symmetrically arranged tie inhibits distortion or collapse of the arches in the symmetrically opposite direction.

12. The life raft as claimed in claim 2 wherein thwarts comprising inflatable tube members extend across the raft body above the floor.

13. The life raft as claimed in claim 12 wherein at least two thwarts are provided transversely of the elongate raft body and in vertical alignment with the at least two arches.

14. The life raft claimed in claim 1 wherein a canopy with at least one entrance covers the arches and is secured to the raft body.

15. The life a raft claimed in claim 1 wherein the arches extend mutually perpendicular to each other on the raft body and one interconnecting tube extends diagonally between upper ends of the arches.

16. The life raft claimed in claim 1 wherein a sub-panel comprising an array of inflatable tubes is provided on the underside of the side walls and floor to space the floor from the surface of water.

* * * * *